United States Patent [19]

Hallberg

[11] 4,155,336

[45] May 22, 1979

[54] CHARGE FORMING APPARATUS WITH FUEL AIR RATIO CONTROL

[75] Inventor: Irving H. Hallberg, Des Plaines, Ill.

[73] Assignee: Borg-Warner Corporation, Chicago, Ill.

[21] Appl. No.: 866,429

[22] Filed: Jan. 3, 1978

[51] Int. Cl.[2] ..... F02M 39/00

[52] U.S. Cl. ..... 123/119 EC; 123/139 AW; 60/276

[58] Field of Search ..... 123/119 EC, 139 AW, 123/32 EE, 32 EJ, 139 AM, 139 B, 139 G, 102, 139 AT; 261/36 A, 39 D, 171, DIG. 39

[56] References Cited

U.S. PATENT DOCUMENTS

| | | | |
|---|---|---|---|
| 3,332,406 | 7/1967 | Perry et al. | 123/102 |
| 3,724,823 | 4/1973 | Latlchales | 123/139 AM |
| 3,880,125 | 4/1975 | Ranmerrer et al. | 123/139 AW |
| 4,062,337 | 7/1978 | Rivera | 123/32 EE |
| 4,085,716 | 4/1978 | Minami | 123/119 EC |
| 4,088,100 | 5/1978 | Tokura et al. | 123/119 EC |
| 4,099,377 | 7/1978 | Yoshimura et al. | 60/276 |
| 4,102,313 | 7/1978 | Laprade et al. | 123/32 EE |
| 4,105,000 | 8/1978 | Wessel et al. | 123/139 AW |
| 4,114,579 | 9/1978 | Stumpp | 123/139 AW |
| 4,119,074 | 10/1978 | Mosaki et al. | 60/276 |

*Primary Examiner*—Charles J. Myhre
*Assistant Examiner*—R. A. Nelli
*Attorney, Agent, or Firm*—Herman E. Smith

[57] ABSTRACT

Charge forming apparatus for an internal combustion engine of the type in which a fuel dispersion gap is subjected to impingement by an inducted air stream is provided with pneumatic control means for varying the area of the fuel dispersion gap. An additional feature of the invention includes regulation of back pressure on the fuel.

9 Claims, 1 Drawing Figure

CHARGE FORMING APPARATUS WITH FUEL AIR RATIO CONTROL

BACKGROUND OF THE INVENTION

1. Field

The present invention relates to charge forming apparatus for forming a fuel and air mixture of the type in which a stream of air impinges upon a stream of fuel in an exposed portion of a fuel channel displacing fuel from the channel and entraining the displaced fuel into the air stream to form a fuel and air mixture.

2. Prior Art

The prior art includes U.S. Pat. No. 3,785,627 which shows charge forming apparatus in which fuel is dispersed from an opening in a fuel channel due to impingement thereon of a stream of inducted air. The length of the opening in the fuel channel is manually adjustable for adjusting the fuel air ratio provided by the apparatus.

The prior art also includes U.S. Pat. No. 3,977,382 which discloses variable restriction in a fuel circuit for influencing the proportion of fuel displaced from a fuel channel into an air stream.

In addition U.S. patent application Ser. No. 797,159, filed May 16, 1977 discloses an electrical control system for a servo motor coupled to drive a movable receiver for establishing an average value of an opening in a fuel channel and thus maintain an optimum average value of the fuel air ratio.

SUMMARY OF THE INVENTION

The present invention is directed to improvements in charge forming apparatus for an internal combustion engine in which a stream of inducted air impinges upon a stream of fuel for displacing fuel into the air stream, the fuel stream being conducted in a fuel channel having relatively movable elements for defining the area of the fuel stream exposed to the air stream. Pneumatic drive means is provided for reciprocably moving elements of a fuel channel for defining a variable area of the fuel stream exposed to the air stream. In addition, elements of the fuel channel may include fuel flow restrictor means operable for varying the flow rate of fuel while varying the area of the fuel stream exposed to the air stream.

BRIEF DESCRIPTION OF THE DRAWING

The drawing is a schematic view of charge forming apparatus and control therefor with certain elements shown in section.

DESCRIPTION OF THE PREFERRED EMBODIMENT

Figure 1:
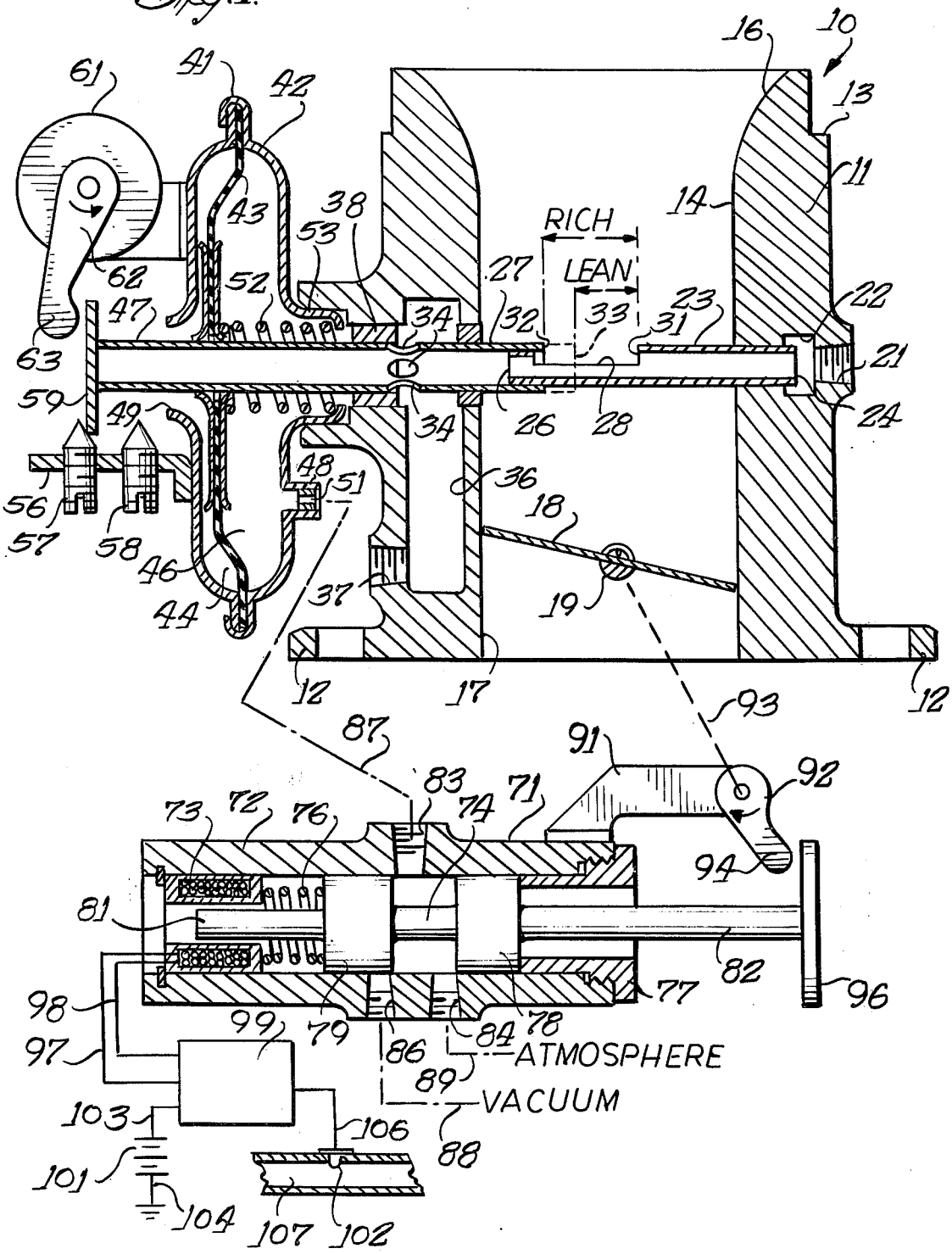

Referring in more detail to the drawing, charge forming apparatus 10 includes a body 11 having a flange 12, 12 for connection to the inlet manifold of an internal combustion engine, and a shoulder 13 for mounting an air filter. An air induction passage 14 is formed in body 11 and includes an upstream air induction end 16 and a downstream mixture outlet end 17. A throttle plate 18 is mounted on a rotatable throttle shaft 19 and disposed in induction passage 14, the throttle plate being rotatable for controlling the rate of flow of air inducted through induction passage 14. In the position shown in the drawing, the throttle plate 18 is rotated to block air flow through passage 14, and is rotatable in a clockwise direction to permit increasing air flow through passage 14.

A fuel inlet port 21 is formed in body 11 and communicates with a fuel inlet cavity 22. A hollow jet tube 23 is mounted in body 11 having one end 24 in communication with inlet cavity 22. The opposite end portion 26 of jet tube 23 is received within a hollow receiver tube 27. A portion of jet tube 23 is cut away to define a fuel dispersion gap 28 facing upstream toward inlet end 16 of induction passage 14. The jet tube 23 and receiver tube 27 define a fuel channel extending across air induction passage 14. Receiver tube 27 is mounted in body 11 for reciprocation with respect to jet tube 23 whereby the effective area of the dispersion gap 28 is varied between RICH and LEAN limits. In the RICH limit position, the effective area of the dispersion gap 28 is defined by edge 31 of jet tube 23 and by end 32 of receiver tube 27. Receiver tube 27 is movable with respect to jet tube 23 toward a position indicated by broken line 33 for reducing the effective length and therefore the effective area of dispersion gap 28 to define a LEAN limit between displaced end 33 and edge 31.

Receiver tube 27 includes fuel outlet openings 34 which communicate with a fuel outlet cavity 36 which in turn communicates with a fuel outlet port 37. A sleeve bearing 38 mounted in body 11 slideably supports receiver tube 27, and in addition forms a collar which overlaps openings 34, 34 when receiver tube 27 is in the extreme RICH limit position to provide a restriction in the fuel flow circuit. The fuel flow restriction provided by the openings 34, 34 and collar 38 is variable due to reciprocatory movement of receiver tube 27. As the receiver tube 27 is moved toward the left hand or RICH limit position, the effective area of dispersion gap 28 is increased while the area of the openings 34, 34 is reduced, and as the receiver tube 27 is moved toward the right hand or LEAN limit position, the effective area of the fuel dispersion gap is decreased while the effective area of the openings 34, 34 is increased. The restriction in the fuel circuit provided by collar 38 and openings 34, 34, is a feature which complements the variation in dispersion gap area for controlling fuel air ratios. The complementary relationship of variable fuel dispersion gap area and variable fuel flow restriction can be described in terms of the following example of operation of the device. With fuel flowing from inlet port 21 to outlet port 37 through fuel channel 23, 27 and with air flowing through induction passage 14, the air stream impinges upon the fuel stream in dispersion gap 28, stripping fuel from the fuel stream for mixture with the air stream. As receiver tube 27 is moved toward a leaner position, the area of the fuel dispersion gap is reduced which results in less fuel being displaced into the air stream; on the other hand, as receiver tube 27 is moved toward the richer position, the area of the fuel dispersion gap is increased resulting in more fuel being displaced into the air stream. With regard to restriction in the fuel circuit, a greater restriction downstream of the channel increases back pressure which reduces the flow rate of the fuel and increases the amount of fuel displaced from the channel while a lesser downstream restriction increases the flow rate of fuel and reduces the amount of fuel displaced from the channel. Where these two features are used in combination, movement of receiver tube 27 toward the rich position simultaneously increases the area of the dispersion gap and increases the back pressure on the fuel resulting in increased displacement of fuel from the channel. On the other hand, movement of receiver tube 27 toward the lean position reduces the area of the dispersion gap while reducing back pressure on the fuel resulting in reduced displacement of fuel from the channel. While the control of dispersion gap area or the control of back pressure are separately effective for regulating fuel air ratio, the combination thereof is useful where rapid changes in fuel-air ratio is desired.

Preferably the relative positions of openings 34 and sleeve 38 are selected such that the sleeve restricts the openings 34 in the extreme RICH position but leaves the openings 34 unrestricted in intermediate RICH positions. This provides both fuel back pressure control and dispersion gap area control for cold start and warm up conditions while only dispersion gap area control is used during normal operation. The thermally actuated movable stop 63 controls the degree of overlap of collar 38 and openings 34 during warm up and eliminates the overlap after the engine is warm.

Pneumatic drive means is provided for reciprocating receiver tube 27 and includes a pneumatic expansion chamber motor 41. A housing 42 and diaphragm 43 define opposing chambers 44, 46 on opposite sides of the diaphragm. The diaphragm 43 is secured to a movable member 47 which may be connected to the receiver tube 27 or as shown in the drawing made integral with the receiver tube. Housing 42 is provided with a port 48 communicating with chamber 46 and an opening 49 communicating chamber 44 with atmosphere. An orifice sleeve 51 is secured in port 48. A biasing spring 52 is disposed in chamber 46 acting between diaphragm 43 and a neck portion 53 of housing 42 urging diaphragm 43 and receiver tube 27 toward the left hand RICH limit position. The pneumatic motor is secured to body 11.

A plate 56 extending from housing 42 serves as a means for mounting a RICH limit adjusting screw 57 and a LEAN limit adjusting screw 58, which cooperate with a flange 59 on movable member 47 for limiting travel of receiver tube 27. The limit screws 57 and 58 include tapered or conical points engageable with flange 59. The LEAN limit screw 58 is adjusted to provide the minimum length of fuel dispersion gap 28. The RICH limit screw 57 is adjusted to provide the maximum length of dispersion gap 28. An auxiliary RICH limit thermal device 61 is mounted on pneumatic motor 41 and includes a thermal sensing element of the type used in an automatic choke of a conventional carburetor. The thermal element drives an arm 62 in counterclockwise direction with increasing temperature. Arm 62 includes a stop portion 63 which is movable into interfering engagement with flange 59 to limit movement of receiver tube 27 in the RICH direction at elevated temperatures.

A solenoid operated control valve 71 includes a body 72, a solenoid 73, a spool member 74, a biasing spring 76 and a stop 77. Spool member 74 includes a pair of spaced land portions 78, 79, an armature portion 81 and an extension portion 82. Body 72 includes a motor port 83, an atmospheric port 84 and a vacuum port 86. Motor port 83 is connected to port 48 of motor 41 by means of tubing indicated by broken line 87 while vacuum port 86 is connected to a source of vacuum by tubing indicated by line 88. Atmospheric port 84 is connected to a source of filtered atmospheric air by tubing indicated by line 89. A bracket 91 is secured to valve body 71 and supports a pivotally mounted arm 92 which is drivingly connected to throttle shaft 19 by means of a linkage indicated by line 93. Arm 92 includes a bar portion 94 which is rotated toward and from interfering engagement with a flange 96 secured to spool 74.

A circuit for controlling energization and deenergization of solenoid 73 is represented schematically by leads 97, 98, amplifier 99, an electrical power source 101, a sensor 102 and connecting leads 103, 104, 106. A remote condition is indicated by exhaust gas passage 107. Preferably the sensor 102 is of the type which provides a change in voltage as a function of the oxygen content of exhaust gasses. While only one sensor is indicated in the drawing, it is to be understood that various sensors may be employed for sensing a variety of remote conditions and combinations thereof such as temperature and engine speed, as well as the content of the exhaust gasses.

In the drawing the various movable elements of the apparatus are shown in positions occupied immediately prior to starting of a cold engine. Receiver tube 27 is in the extreme RICH limit position biased against limit screw 57 by spring 52. Chamber 44 is open to atmosphere through opening 49 and chamber 46 is communicated to atmosphere through orifice sleeve 51, tube 87, port 83, and port 84 and passage 89. Spool 74 of valve 71 is biased against stop 77 by spring 76 while solenoid 73 is deenergized. When the engine is idling, the throttle plate 18 is rotated slightly clockwise which causes arm 92 and bar 94 to move in a direction increasing the distance between bar 94 and flange 96. If the mixture becomes too rich, the sensor 102 provides a signal to amplifier 99 which energizes solenoid 73 for moving spool 74 away from stop 77 until flange 96 engages bar 94 in its slightly rotated position. The spool land 78 closes atmospheric port 84 while land 79 opens vacuum port 86 for exhausting chamber 46 through orifice sleeve 51, tube 87 and motor port 83 causing diaphragm 43 and receiver tube 27 to move slowly toward the lean limit position. As soon as sensor 102 senses a lean condition in the exhaust, the solenoid 73 is deenergized permitting spring 76 to move spool 74 against stop 77 such that chamber 46 is again connected to atmosphere through valve 71 resulting in slow movement of diaphragm 43 and receiver tube 27 toward the RICH position. The back and forth movement of receiver tube 27 continues, resulting in continuous correction of the fuel air ratio toward desirable proportions of fuel and air in the mixture. As the engine becomes warm, it has been found desirable to inhibit movement of receiver tube 27 to the extreme RICH limit. The inhibition of movement of receiver tube 27 toward the RICH limit is accomplished by movement of arm 62 and stop 63 as engine temperature increases. The interaction of stop 63 with flange 59 results in holding receiver tube in an intermediate RICH position.

The restricted motion of spool 94 at throttle positions near idle results in slower response of receiver tube 27. When the engine is operating at higher than idle speed, the throttle plate 18 is rotated to a more nearly vertical position carrying arm 92 and bar 94 out of interference with flange 96 of valve 71 permitting greater travel of spool 94 when solenoid 73 is energized calling for a lean condition.

What is claimed is:

1. Charge forming apparatus for forming a fuel-air mixture including a body having an air induction passage defined therein, movable throttle means disposed in said air induction passage, and a fuel channel extending across said induction passage, said fuel channel including a jet tube having an end portion thereof received within a receiver tube, said jet tube and said receiver tube defining a fuel dispersion gap, said receiver tube being mounted for reciprocation with respect to said jet tube for varying the area of said fuel dispersion gap, wherein the improvement comprises pneumatic drive means for controlling reciprocation of said receiver tube, said drive means including a pneumatic expansion chamber motor having a movable member drivingly connected to said receiver tube, a solenoid operated pneumatic valve communicating with said expansion motor including a movable element actuatable for communicating said expansion motor with atmosphere, said valve being effective for controlling extension and retraction of said motor member responsive to energization and deenergization of said solenoid, and circuit means connected to said solenoid for selectively energizing said solenoid.

2. Charge forming apparatus according to claim 1, wherein said circuit means includes a sensor disposed for sensing a remote condition, said sensor providing control signals in response to changes in said remote condition for regulating energization of said solenoid.

3. Charge forming apparatus according to claim 1, including movable stop means engageable with a portion of said drive means for limiting movement of said receiver tube.

4. Charge forming apparatus according to claim 3, including a temperature responsive element connected to said stop means for positioning said stop means in accordance with a sensed temperature condition, said stop means limiting travel of said receiver tube for restricting the area of said fuel dispersion gap with increase of temperature.

5. Charge forming apparatus according to claim 1, including a movable bar connected to said throttle means for movement therewith, said bar including a portion engageable with said valve movable element for limiting operation thereof.

6. Charge forming apparatus according to claim 1, including a pneumatic flow restrictor communicating with said expansion chamber motor effective for regulating the rate of expansion and retraction of said motor movable element.

7. Charge forming apparatus according to claim 1, said drive means including bias means urging said receiver tube in a direction for increasing the area of said fuel dispersion gap, said expansion motor being operable in response to energization of said solenoid for moving said receiver tube in a direction for reducing the area of said fuel dispersion gap.

8. Charge forming apparatus as in claim 1 wherein the improvement further comprises variable fuel flow restriction means operable in response to reciprocation of said receiver tube for varying the rate of flow of fuel in said channel.

9. Charge forming apparatus according to claim 8, said receiver tube including a fuel outlet opening receivable within a collar defining said variable fuel flow restrictor, said receiver tube being movable in one direction for increasing the area of said fuel dispersion gap while decreasing the area of said fuel outlet opening and being movable in the opposite direction for decreasing the area of said fuel dispersion gap while increasing the area of said fuel outlet opening.

* * * * *